US005301472A

United States Patent [19]

Lyng

[11] Patent Number: 5,301,472

[45] Date of Patent: Apr. 12, 1994

[54] SANDING ELEMENT AND APPARATUS

[76] Inventor: James W. Lyng, 2350 SW. 42nd Ter., Fort Lauderdale, Fla. 33317

[21] Appl. No.: 40,388

[22] Filed: Mar. 30, 1993

Related U.S. Application Data

[63] Continuation of Ser. No. 702,397, May 20, 1991, abandoned.

[51] Int. Cl.[5] ..... B24B 23/02

[52] U.S. Cl. ..... 51/180; 51/170 PT; 51/334

[58] Field of Search ..... 51/176, 180, 334, 357, 51/168, 170 R, 170 PT

[56] References Cited

U.S. PATENT DOCUMENTS

| | | | |
|---|---|---|---|
| 2,913,857 | 11/1959 | Reed et al. | 51/334 |
| 3,498,009 | 3/1970 | Taafe, Jr. | 51/393 |
| 3,706,167 | 12/1972 | Schaffner | 51/334 |
| 3,795,498 | 3/1974 | Hasegawa | 51/297 |
| 3,872,630 | 3/1975 | Ali | 51/334 |
| 4,104,756 | 8/1978 | Gasser et al. | 51/334 |
| 4,204,292 | 5/1980 | Lester et al. | 51/180 |
| 4,365,448 | 12/1982 | Wilson | 51/334 |
| 4,567,619 | 2/1986 | Clark | 51/334 |
| 4,585,226 | 4/1986 | Labate | 51/334 |
| 4,653,135 | 3/1987 | Clark | 51/334 |
| 4,780,992 | 11/1988 | McKervey | 51/180 |
| 4,782,632 | 11/1988 | Matechuk | 51/180 |
| 4,872,292 | 10/1989 | Block | 51/334 |
| 4,882,880 | 11/1989 | Schaffner, II et al. | 51/168 |

FOREIGN PATENT DOCUMENTS

| | | | |
|---|---|---|---|
| 2519363 | 11/1976 | Fed. Rep. of Germany | 51/334 |
| 0149164 | 9/1982 | Japan | 51/334 |
| 0175959 | 10/1984 | Japan | 51/334 |
| 0114882 | 5/1987 | Japan | 51/334 |

*Primary Examiner*—Roscoe V. Parker
*Attorney, Agent, or Firm*—Oltman and Flynn

[57] ABSTRACT

An apparatus for sanding a work piece is provided which includes a mounting surface for abrasive strips and has an axis of rotation. Several of these strips are oriented radially with relation to the axis and laterally to themselves and at least a portion of the strips are surfaced with an abrasive material. These strips are optionally attached to mounting sleeves having a first elastic sleeve adapted to be fitted over the mounting surface. The apparatus preferably includes at least one telescopic housing. Within the housing is a drive shaft including a flexible drive shaft portion and a telescopic drive shaft portion. A motor drive system is also provided. A pivot mechanism is also provided to pivot the drive shaft and the axis of rotation of the apparatus.

55 Claims, 10 Drawing Sheets

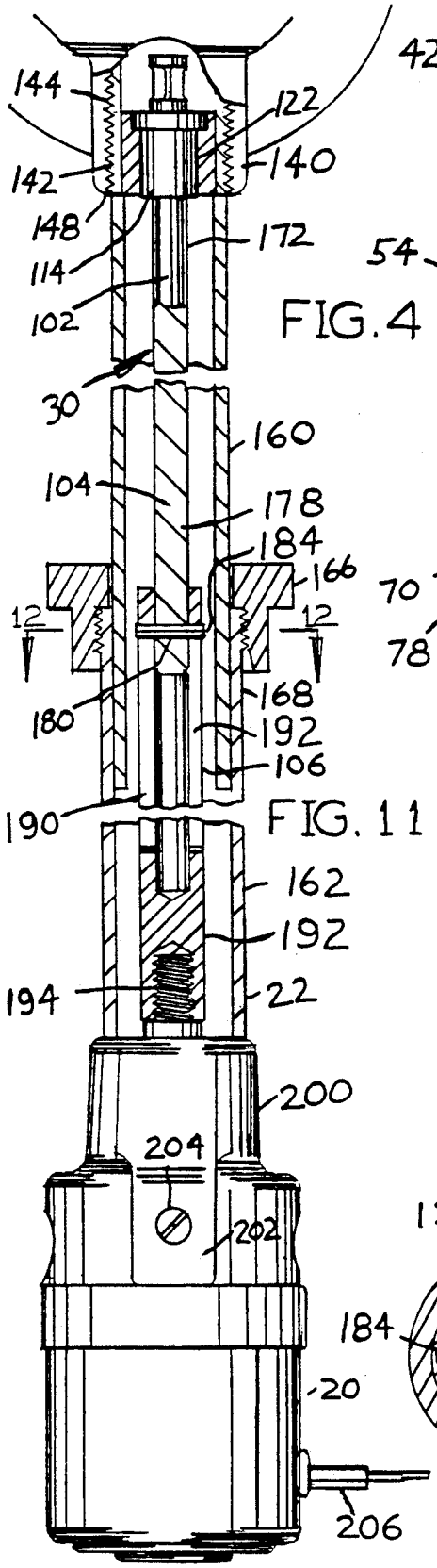
FIG. 4
FIG. 11
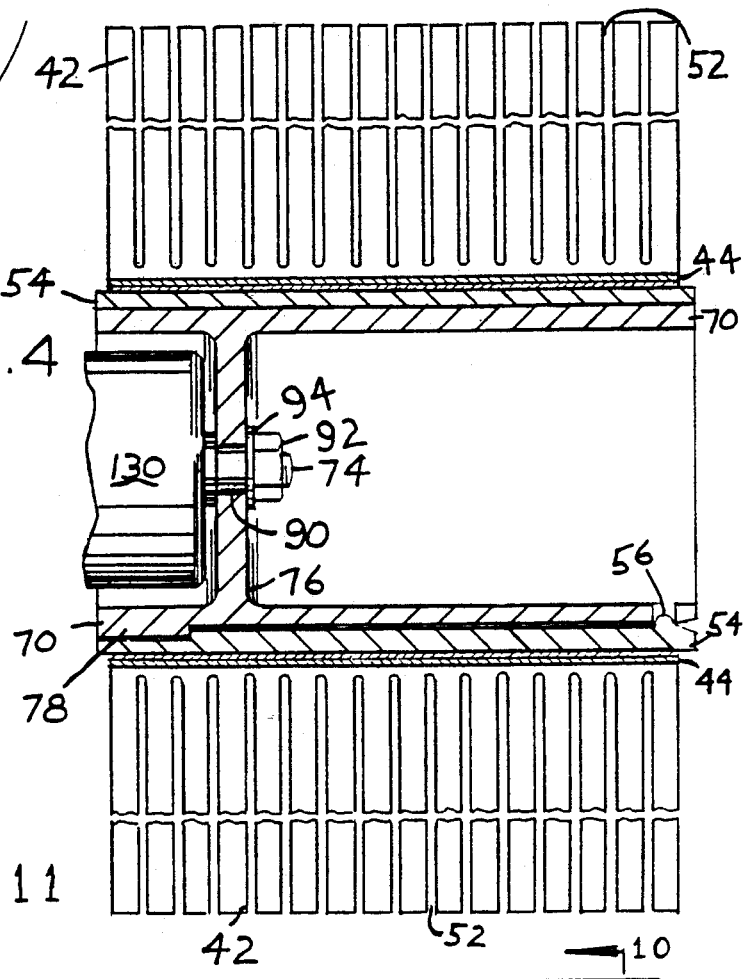
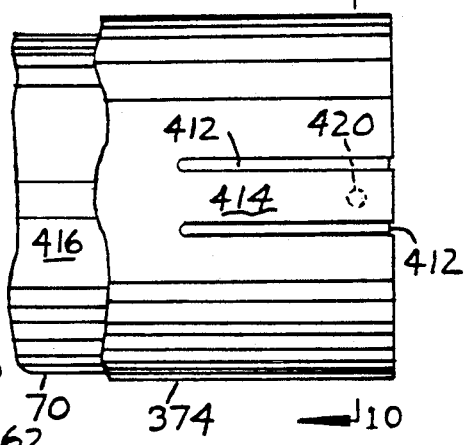
FIG. 9
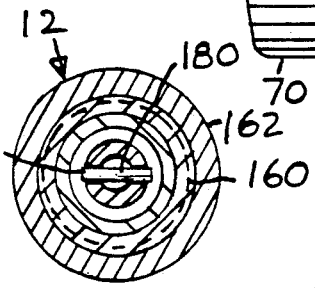
FIG. 12
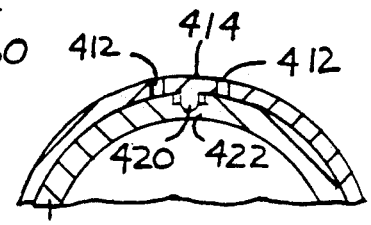
FIG. 10

310
312
314
317
318
320
322
324
326
330
332
334
336
338
340
342
346
370
21

SANDING ELEMENT AND APPARATUS

This application is a continuation of application Ser. No. 07/702,397, filed May 20, 1991 and now abandoned.

BACKGROUND OF THE INVENTION

1. Field of the Invention

The present invention relates generally to the field of automatic sanding devices, and more specifically to an electric sanding apparatus having a telescoping tubular body and to a rotary sanding element having multiple abrasive flaps.

2. Description of the Prior Art

There has long been a need for a portable, lightweight, automatic sanding tool to replace manual sanding of doors, jambs, casings, louvered bifolds, shutters and the like, having unfinished surfaces which need sanding after priming or sealing, or having previously painted surfaces which need sanding before application of finish coats of paint.

A variety of automatic sanding devices and elements is found in the prior art. One such device is taught in Taafe, U.S. Pat. No. 3,498,009, issued Mar. 3, 1970. Taafe discloses a cylindrical sanding element and element rotating device, resembling a paper towel rack with a motor and handle on it. A problem with Taafe is that its broad uniform sanding element would only make contact with the high points of an uneven surface. Recessed areas would thus remain unsanded. Also, the reach of Taafe is only a few inches beyond its handle, making Taafe unsuited for reaching high or otherwise hard to reach areas.

A finishing wheel or element is disclosed in Schaffner, U.S. Pat. No. 3,706,167, issued Dec. 19, 1972. Schaffner comprises an annulus of flaps bonded near the center to form a substantially solid hub. This hub is mounted on any of several rotary tools. Narrow Schaffner flaps would effectively sand between projections and within valleys of surface undulations. Yet they would also cover only a small surface area at a given moment, making the sanding job very time-consuming. On the other hand, wide Schaffner flaps would be unable to reach between surface peaks, as in Taafe. Therefore, Schaffner is either excessively slow or simply unsuited to sanding uneven surfaces.

Hasegawa, U.S. Pat. No. 3,795,498, issued Mar. 5, 1974, teaches a method of making a sanding wheel from a stack of abrasive, flexible leaves. Grooves are cut in the edges of the stack. An adhesive-covered string is inserted into these grooves and the leaves are then radially wrapped around a hub. Hasegawa is simply the wide flap version of Schaffner, and is thus unsuited to evenly sanding undulating surfaces.

Ali, U.S. Pat. No. 3,872,630, issued Mar. 25, 1975, is another variation of radially-mounted flaps on a hub. Ali provides a means of inserting clusters of flaps, fastened together face-to-face at one end, into a specially slotted hub portion. The problems of Ali when applied to undulating surfaces are identical to those of Schaffner and Hasegawa. The same is true of Wilson, U.S. Pat. No. 4,365,448, issued Dec. 28, 1982 and of Block, U.S. Pat. No. 4,872,292, issued Oct. 10, 1989.

It is thus an object of the present invention to provide a sanding element which can evenly and rapidly sand undulating surfaces and surfaces having projecting portions.

It is another object of the present invention to provide a sanding apparatus which can reach high up and otherwise difficult to reach areas without overbalancing and which is operated from controls remote from the sanding element.

It is still another object of the present invention to provide such a sanding apparatus which both pivots and telescopes to accommodate the widest possible range of applications and needs.

It is still another object of this invention to provide a sanding apparatus and sanding element to the skilled tradesman as well as to the ordinary do-it-yourselfer, which effectively sands planar as well as irregular surfaces quickly, efficiently, at low cost and with minimal labor.

It is finally an object of the present invention to provide such a sanding apparatus and sanding element which are relatively inexpensive, simple in construction and sufficiently compact to permit easy transport and storage.

SUMMARY OF THE INVENTION

The present invention accomplishes the above-stated objectives as well as others, as may be determined by a fair reading and interpretation of the entire specification.

An apparatus for sanding a work piece is provided which includes a mounting surface for abrasive strips having an axis of rotation and a plurality of strips disposed radially with relation to the axis and laterally to themselves with at least a portion of said strips comprising abrasive material. These strips are optionally attached to sleeve means comprising a first elastic sleeve adapted to be fitted over the mounting surface.

The apparatus preferably comprises at least one telescopic housing. Within the housing is a drive shaft including a first flexible drive shaft portion and a second drive shaft portion. A motor drive system is also provided. Pivot means associated with the drive shaft and the axis of rotation of the apparatus are preferably provided.

BRIEF DESCRIPTION OF THE DRAWINGS

Various other objects, advantages, and features of the invention will become apparent to those skilled in the art from the following discussion taken in conjunction with the following drawings, in which:

1.

2.

3.

4. FIG. 4 is a partial cross-section of a cylinder and a sanding element, taken along line 4—4 of FIG. 2.

5.

6.

7.

8.

9. FIG. 9 is a fragmentary top elevation taken along line 9—9 in FIG. 8.

10. FIG. 10 is a fragmentary section taken along line 10—10 of FIG. 8.

11. FIG. 11 is a broken sectional elevation view of the tubular body showing the telescoping portions of the drive members and also showing the motor bracket.

12. FIG. 12 is a full section taken along line 12—12 in FIG. 11.

13.

14.

15.

16.

17.

18.

19.

20.

21.

22.

23.

24.

25.

26.

27.

28.

29.

30.

31.

DESCRIPTION OF THE PREFERRED EMBODIMENTS

Figure 1:
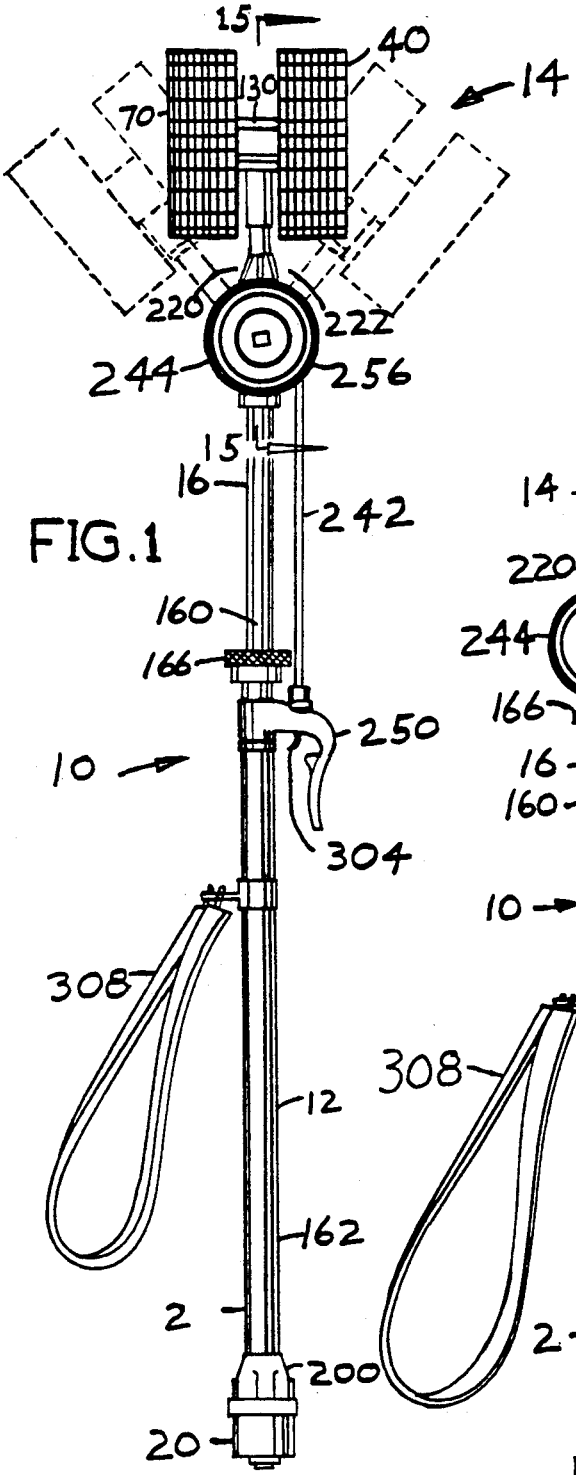
FIG. 1 is a plan view of the first preferred embodiment of the invention showing a pair of sanding elements mounted on rotary cylinders at the sanding end of a telescoping and pivoting tubular body with a motor at the other end. The sanding elements are fitted with rows of abrasive strips. Phantom lines indicate the two full pivot positions.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
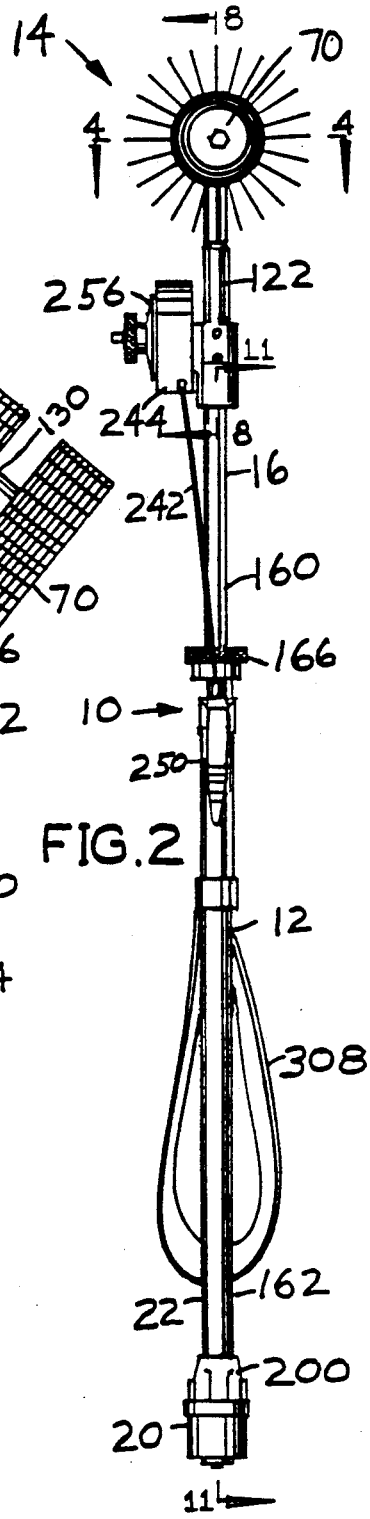
FIG. 2 is a side view of the first preferred embodiment of the invention shown in FIG. 1.
Figure 3:
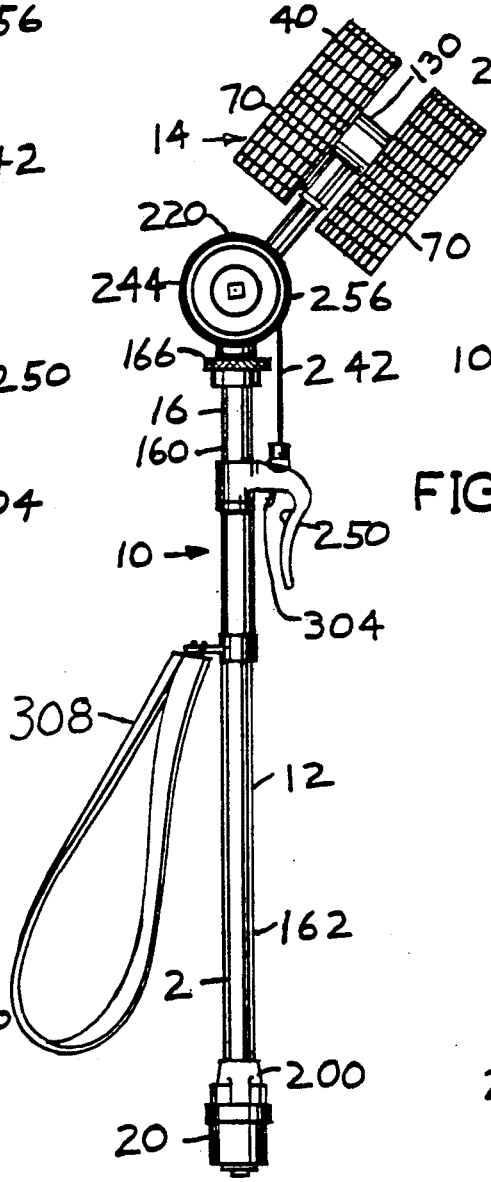
FIG. 3 is a plan view of the first preferred embodiment of the invention showing the tubular body telescoped to its shortest position and its sanding end oriented in one of the two full pivot positions.

Referring now in general to the various FIGURES of the drawings, and in particular to FIGS. 1 and 2, a sanding apparatus 10 is disclosed comprising a tubular body 12, with a rotary sanding assembly 14 at one end 16 and an electric motor 20 at the other end 22. Tubular body 12 preferably both telescopes and pivots to meet a variety of needs. See FIG. 3. Drive members 30 within tubular body 12 transmit torque from motor 20 to assembly 14.

Figure 5:
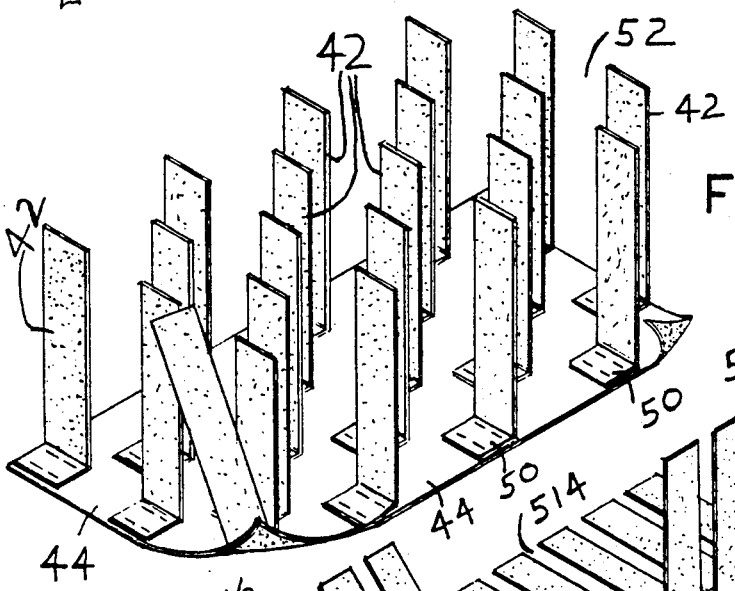
FIG. 5 is a perspective view of a section of sleeve material illustrating the attachment of the strips to the sleeve.

Also disclosed is a sanding element 40 comprising a plurality of long, rectangular abrasive strips 42 attached to a sleeve 44. Strips 42 are attached at one of their short edges 46 and oriented so that edges 46 are parallel to the sleeve 44 longitudinal axis. Flap ends 48 are bent at 90 degrees to form a lip 50. See FIG. 4. Lip 50 is stitched or bonded to sleeve 44. Strips 42 may also be formed from sheets by removing material at spaces 52. See FIGS. 4, 5 and 6.

Figure 6:
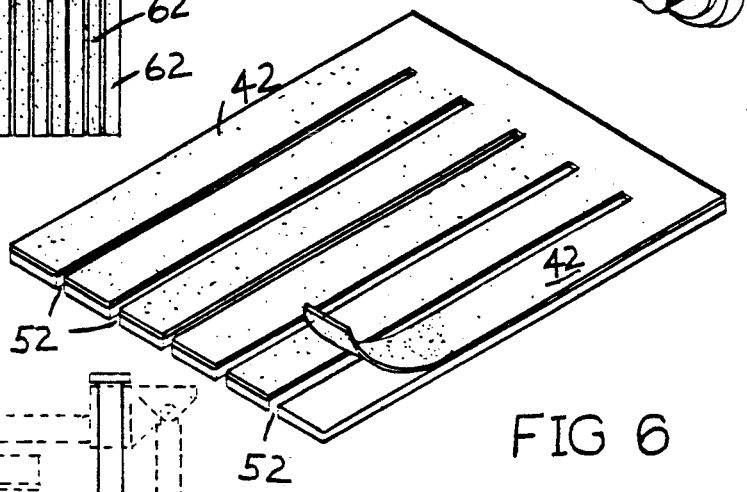
FIG. 6 is a perspective view of a series of strips having a flexible backing to provide added resiliency and strength

The purpose of using abrasive material in the form of strips 42 rather than continuous sheets is to permit sanding element 40 to sand between surface protrusions and to uniformly sand undulating surfaces. Strips 42 are placed in rows parallel to said sleeve 44 axis, closely adjacent to each other, and are staggered so that they overlap. Alternatively, these rows may be mounted at an angle with respect to said axis. A flexible backing material may be bonded to strips 42 for added strength and resiliency, as illustrated in FIG. 6. Strips 42 may optionally be elastic.

Figure 7:
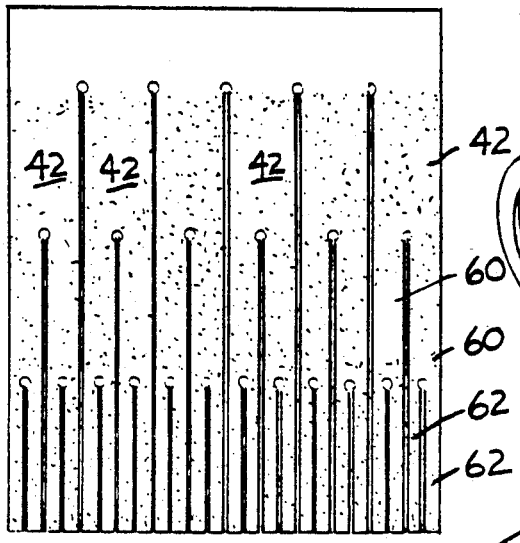
FIG. 7 is an alternative strip design wherein the ends of wide strips are cut to form narrower strips, and these narrower strips are cut to form still narrower strips.

The lengths of strips 42 on a given sleeve 44 may be uniform or varied. The width of strips 42, by the same token, may be uniform or made to vary, depending on the nature of the surface imperfections encountered. In another strip 42 variation the free ends of relatively wide strips 42 are split to form narrow strips 60. See FIG. 7. Narrow strips 60 may in turn be split to form still narrower strips 62, and so on. This variation sands uneven surfaces uniformly with light contact, and levels protruding areas with heavy contact. Heavy contact engages wider strips 44, which can sand peaks but not the areas between peaks, thus creating the leveling effect.

Strips 42, 44, 60 and 62 can be formed of sandpaper or coated plastic or a combination of any support material covered with an abrasive substance. For polishing and buffing, a polishing material such as lambs wool, or the like is preferred.

Sleeves 44 of elements 40 are removably fitted over mounting surfaces in the form of two identical mounting cylinders 70. A tubular sleeve holder 54 may be included between each sleeve 44 and cylinder 70. Holders 54 provide support and ease of mounting for sleeves 44. Indent buttons 56 may be provided on holder 54 to snap into cylinder 70 interior notches 58, securing holders on cylinders 70.

Figure 8:
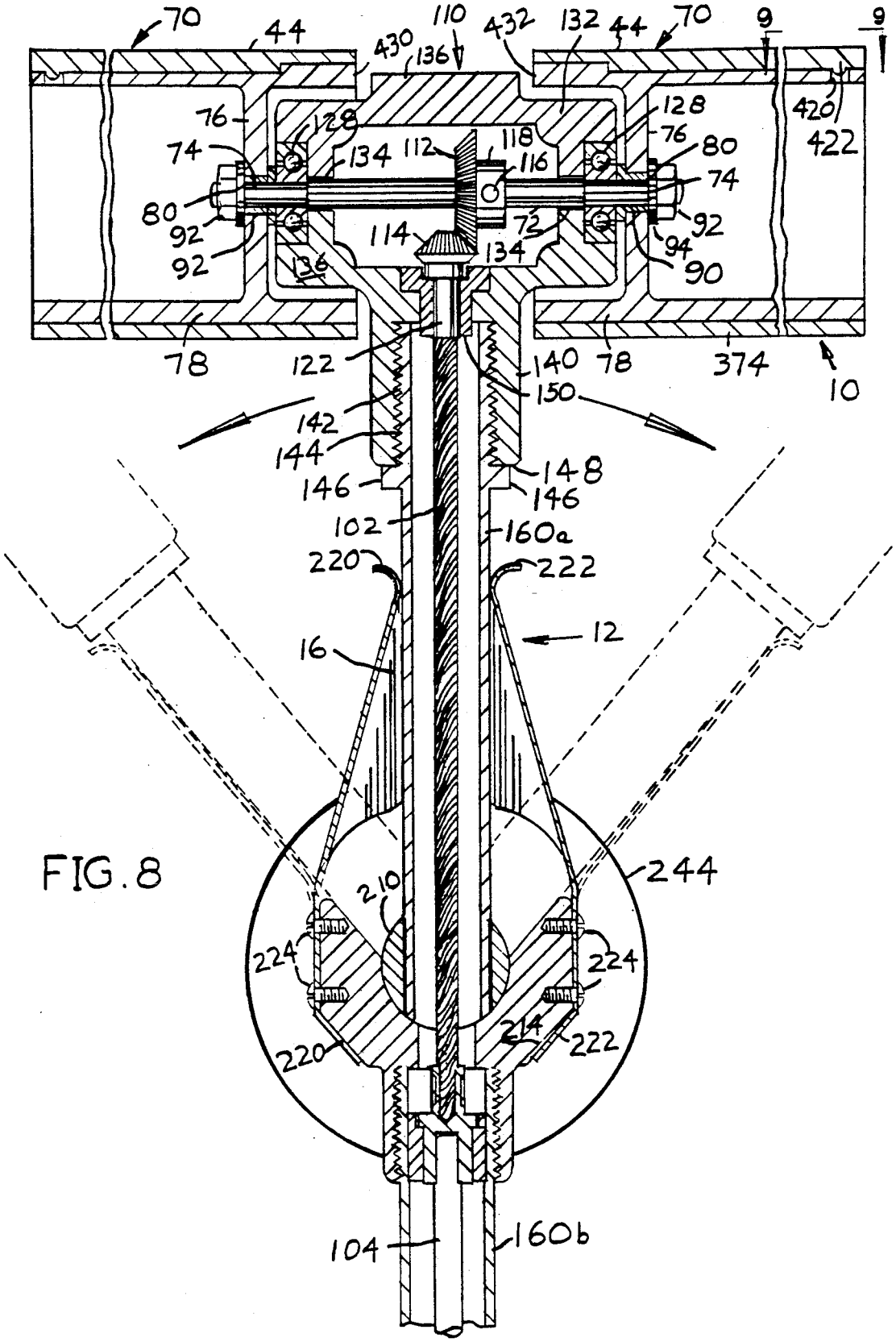
FIG. 8 is a cross-sectional view of the sanding end of the apparatus showing interior elements of the tubular body, of the pivot mechanism, of the transmission housing and of the cylinders, taken along line 8—8 of FIG. 2.

Cylinders 70, provided as part of rotary assembly 14, are preferably tubular and are mounted at either end 74 of an axle 72. See FIGS. 4 and 8. Axle 72 is positioned perpendicular to the longitudinal axis of tubular body 12.

Cylinders 70 each have a solid cross-sectional partition 76 within them, close to one end. This end is hereinafter referred to as partition end 78. Each partition 76 has a hole 80 through its center. A cylinder 70 is mounted by fitting an end 74 of axle 72 into partition end 78, and through hole 80. Each hole 80 is lined with a flanged collar 90, which forms a close sliding fit over axle 72. Either end 74 of axle 72 is threaded and fitted with a nut 92 and washer 94 which fasten against each partition 76 to prevent cylinders 70 from sliding off axle ends 74. As a result, the longitudinal axis of axle 72 is essentially co-linear with the longitudinal axis of each mounting cylinder 70.

Drive members 30 transmit rotary motion from motor 20 to axle 72. From sanding end 16 to motor end 22, drive members 30 preferably comprise a flexible plastic drive shaft or metal cable 102, a rigid shaft 104, and a receiving tube 106. To create the necessary 90 degree change in the axis of rotation, a transmission 110 is provided. Transmission 110 includes two beveled gears or pinions 112 and 114, the first of which is fitted over the middle of axle 72, and the second over the adjacent end of cable 102, respectively. Pinion 112 is secured to axle 72 by a set screw or pin 116 fitted through its stem portion 118. Pinion 114 is secured to cable 102 by a set screw or pin 120 fitted through its stem portion 122, or by crimping its stem portion 122 around cable 102. Pinions 112 and 114 engage each other and each is preferably beveled at 45 degrees. A transmission housing 130 surrounds and contains pinions 112 and 114.

Housing 130 is essentially cylindrical and has two matching ends 132. An axle end 74 protrudes through an axle bore 134 provided in each end 132 of housing 130. Axle bore 134 is fitted with bearings 128. Housing 130 is longitudinally separated into matching half-portions 136. Half-portions 136 are secured together by four screws 138, two in each end 132, one on either side of axle bore 134. Ends 132 of housing 130 are preferably sized to fit within cylinder 70 partition ends 78 without making contact with ends 78. This permits cylinders 70 to partially slide over housing 130, reducing the gap between mounted elements 40.

Tubular body 12 fits into housing 130 at a tubular receptacle 140. Receptacle 140 has internal threads 142 and projects perpendicularly from the main body of housing 130, between cylinder partition ends 78. Sanding end 16 of tubular body 12 has external threads 144 and screws into receptacle 140, engaging threads 142. A lip 146 is provided around sanding end 16 to abut the projecting end 148 of receptacle 140 and act as a stop during insertion of sanding end 16. Stem portion 122 of pinion 114 extends through a flanged collar 150 mounted in the portion 150 of housing 130 contained within receptacle 140.

As noted above, tubular body 12 is formed of two tube sections which telescope so that apparatus 10 can assume a variety of lengths. Tube 160 forms sanding end 16 of body 12, and slides into a second tube 162 which forms motor end 22. See FIGS. 1 and 3. Tube sections 160 and 162 may be formed either of metal of plastic. The sliding fit between tubes 160 and 162 is sufficiently close that there is no noticeable lateral play between them. External threads 164 are provided on tube 162 and engage an internally threaded securing collar 166. See FIG. 11.

Securing collar 166 prevents tube 160 from sliding relative to tube 162. The interior of collar 166 and the exterior of end 168 of tube 162 are correspondingly beveled. Rotating collar 166 in one direction compresses end 168 around tube 160 and in the other loosens it. When a telescoping adjustment is desired, collar 166 is loosened, tube 160 is slid within tube 162, and collar 166 is then tightened.

Drive members 30 telescope simultaneously with tubular body 12. Cable 102, as noted above, is attached to pinion 114 at one end, hereinafter referred to as the cable end 172. The other end of cable 102 is attached to an end of shaft 104, hereinafter referred to as shaft end 174 of cable 102, with a crimping collar 176. See FIG. 8. Crimping collar 176 is positioned within tube 160 by a ring of bearings. The end of shaft 104 opposite its crimped end 176 slides into receiving tube 106, and is hereinafter referred to as sliding end 178 of shaft 104. See FIG. 11. The lengths of shaft 104 and receiving tube 106 are such that, when apparatus 10 is fully extended, a short segment of shaft 104 remains within receiving tube 106.

A guide pin 180 is diametrically fitted through a bore 182 in the sliding end 178 of shaft 104. See FIG. 12. Both guide pin ends 184 project out from shaft 104. An axially oriented slot 190 is provided in either side of receiving tube 106 so that the projecting ends 184 of guide pin 180 extend through them. When tubular body 12 is telescoped, guide pin ends 184 slide within slots 190. Pin ends 184 prevent shaft 104 from rotating relative to receiving tube 106 and from sliding out of tube 106. The length of slots 190 defines the range of tubular body 12 telescoping. The end of receiving tube 106 opposite shaft end 192 fits over and is attached to the rotating shaft portion 194 of electric motor 20. A reduction gear may be included in the drive between the motor 20 and tube 106.

A cylindrical bracket 200 attaches motor 20 to tubular body 12. See FIG. 11. Bracket 200 fits around and engages motor end 22 of tubular body 12. Bracket arms 202 wrap around motor 20. Bolts 204 are screwed through arms 202 and into the motor 20 housing, securing motor 20 to tubular body 12. Motor 20 may draw power from batteries or through an electric cord 206 plugged into to a standard household outlet.

Figure 14:
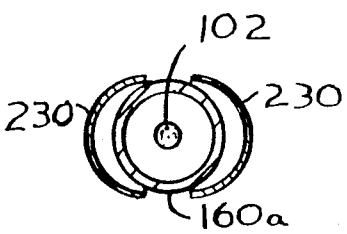
FIG. 14 is a sectional view taken along line 14—14 of FIG. 13.
Figure 13:
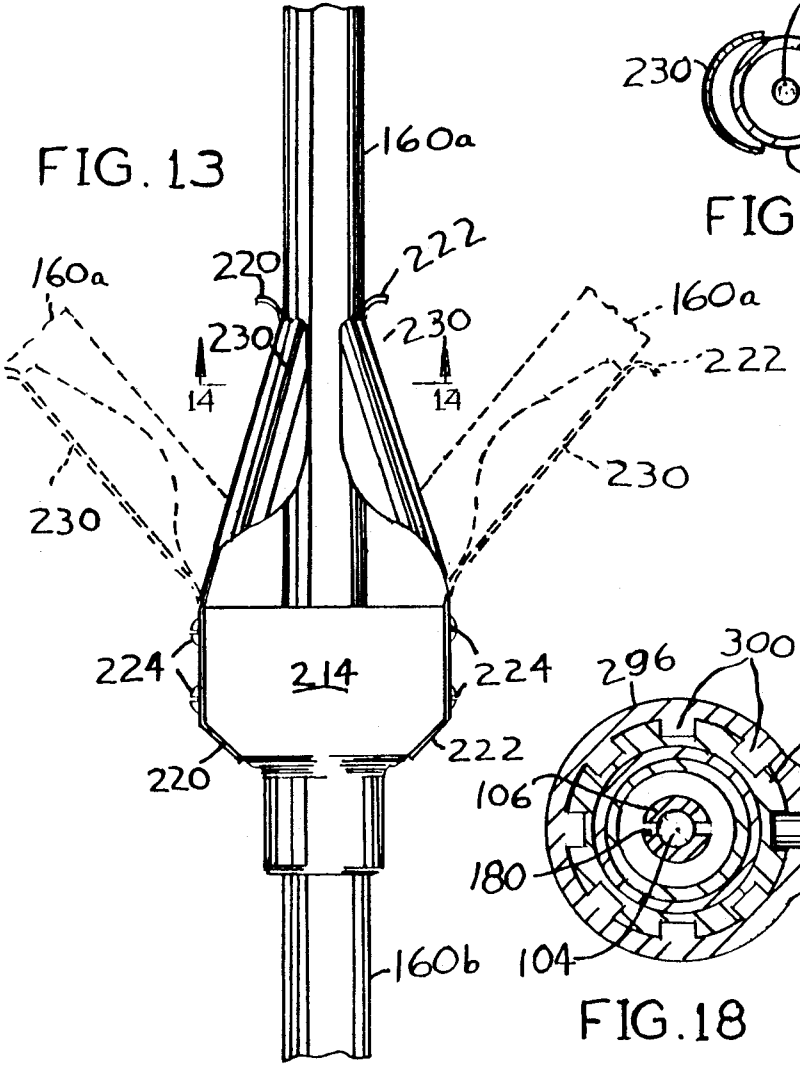
FIG. 13 illustrates the pivotal portion of the tubular body, showing the retaining guide leaves around the leaf springs and showing in phantom lines the two full pivot positions of the sanding end.

The preferred embodiment of apparatus 10 is designed to permit sanding end 16 of body 12 to pivot in two opposing directions approximately 45 degrees. See FIGS. 1 and 3. Tube 160 is broken into two portions. See FIGS. 8, 13 and 14. Leg portion 160*a* is attached to rotary assembly 14 at sanding end 16 and to a ball 210 at its other end 212. Hip portion 160*b* has a socket 214 for receiving ball 210. Fastened to the outer surface 216 of socket 214 are two leaf springs 220 and 222, each held in place by two screws 224. The free ends 226 and 228 of leaf springs 220 and 222 bear against leg portion 160*a* to retain said portion 160*a* in a position axially aligned with the remainder of body 12. Guide leaves 230 may be provided around leaf springs 220 and 222 to prevent them from sliding to one side of leg portion 160*a*. Socket 214 is internally contoured to permit leg portion 160*a* to pivot only directly toward leaf spring 220 or 222.

Since the continuous resistance of one of leaf springs 220 or 222 must be overcome during pivoting, a holding mechanism 240 is provided. Holding mechanism 240 comprises a holding cord 242 coiled within a holding cord housing 244 mounted to the side of socket 214. See FIGS. 1 and 2. Holding cord 242 emerges from an edge of housing 244 remote from body 12. Cord 242 extends parallel to body 12 in the direction of motor 20 and attaches to a handle 250.

Figures 15, 16:
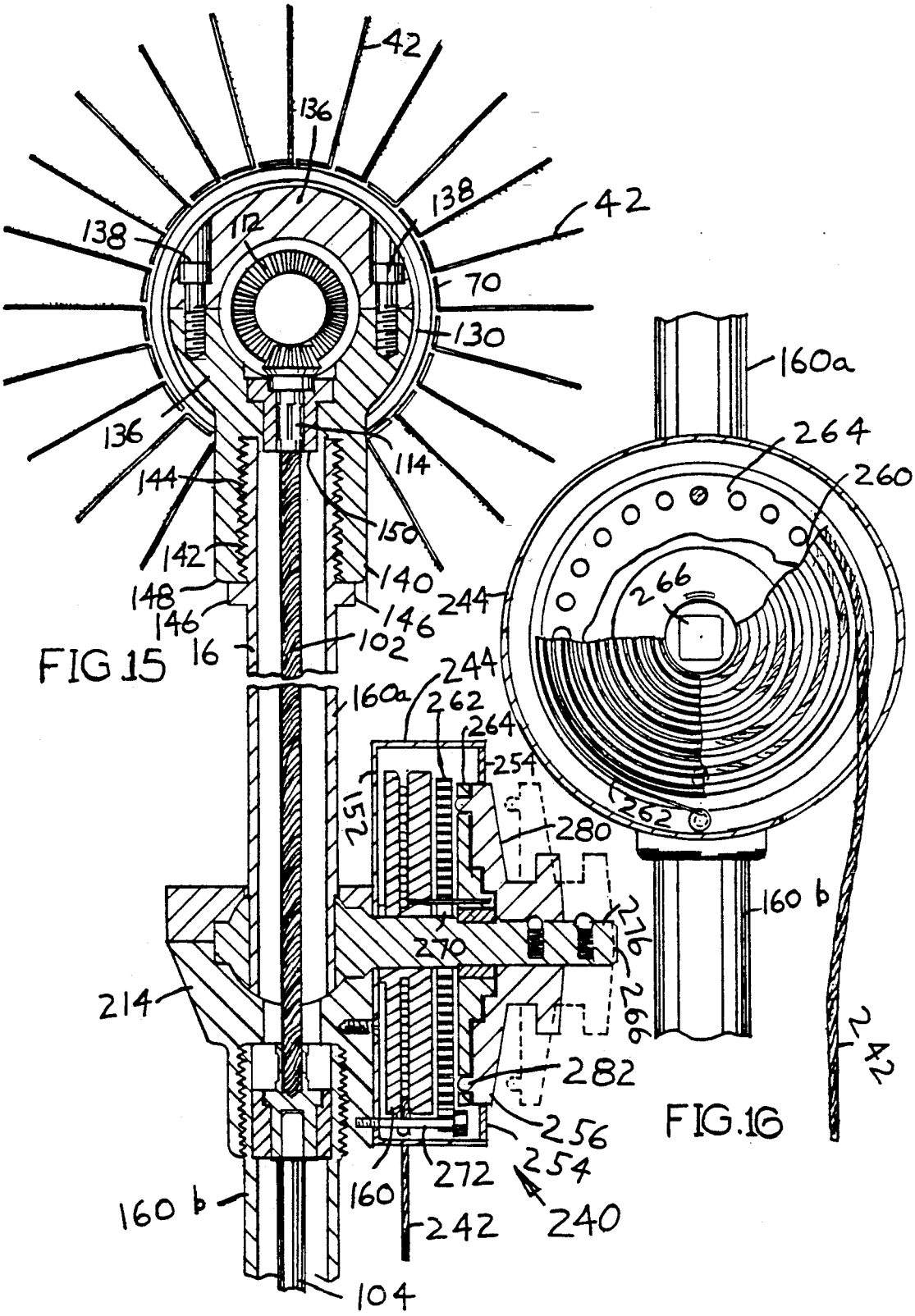
FIG. 15 is a broken sectional side view of the sanding end of the apparatus, taken along line 15—15 of FIG. 1, showing the interior elements of the holding cord housing and showing in phantom lines the out position of the securing knob and also showing a side view of the interior elements of the transmission housing and the drive member pinion connection.
FIG. 16 is a partial sectional front view of the holding cord housing showing the coil of cord, a helical spring, and peripheral holes in an adjustment disk.
Figures 19, 20, 21, 22:
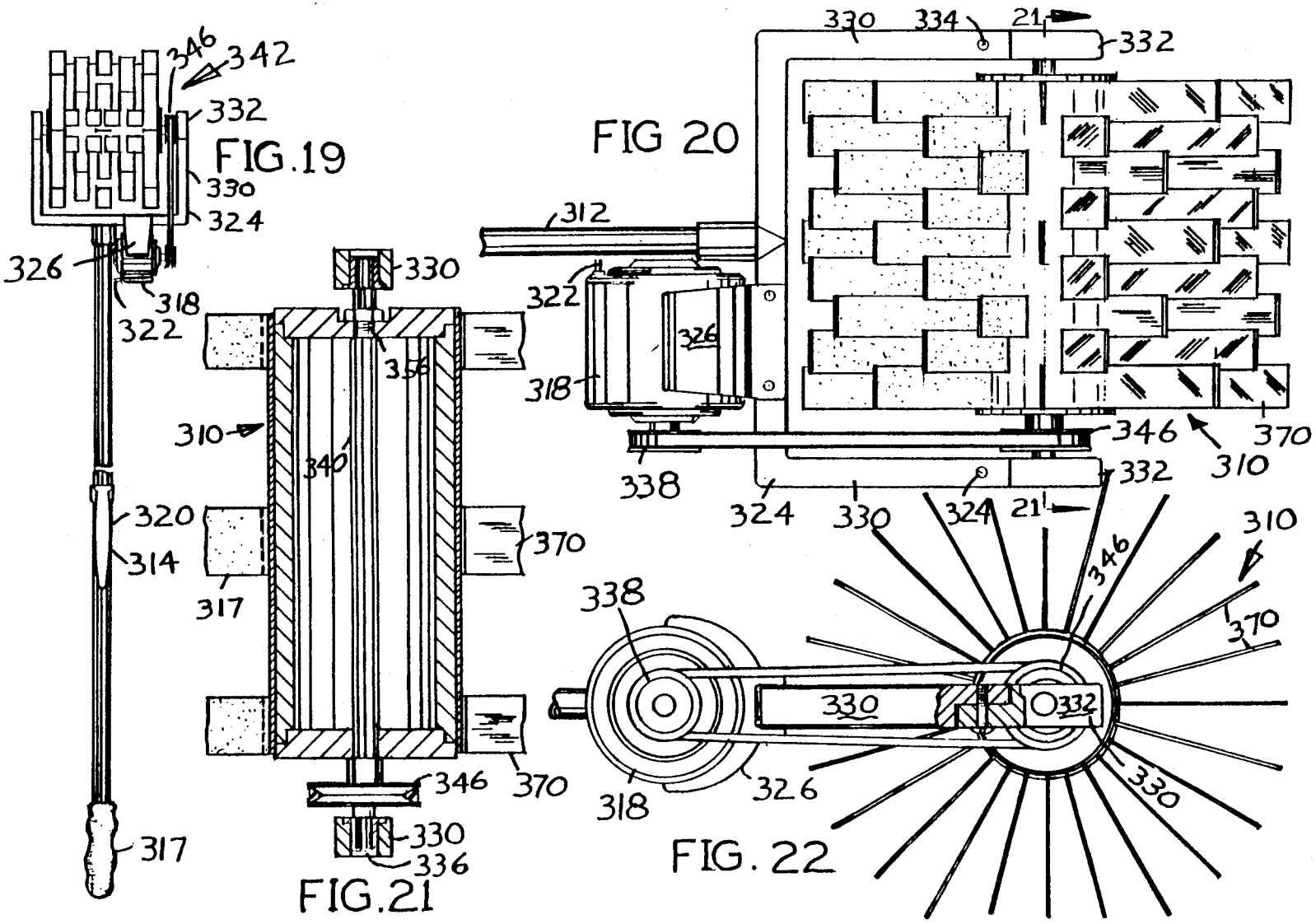
FIG. 19 is a plan view of the second preferred embodiment of the invention showing a rotary sanding element, a motor drive, and a tubular body with a portion broken.
FIG. 20 is an enlarged detail of FIG. 19.
FIG. 21 is a broken horizontal section taken along line 21—21 of FIG. 20.
FIG. 22 is a side elevation of the detail in FIG. 20.

Cord housing 244 is essentially disk-shaped. One face 252 is fastened to socket 214 and the other face 254 has a knob 256 at its center. Cord housing 244, from mounted face 252 to knob 256, contains a spool 260, for cord 242, a helical spring 262 and an adjustment disk 264. See FIG. 15. A shaft 266, attached to ball 210, extends through the axis of housing 244, and thus through the axis of spool 260, spring 262 and adjustment disk 264. The innermost end of cord 242 is fastened to spool 260, and cord 242 winds around itself in helical fashion. The innermost end of helical spring 262 is fastened to a ring 270. The outer end of helical spring 262 is wrapped around and held in position by anchor screw 272 which extends into the body of socket 214.

A key 274 extends through spool 260, ring 270 and disk 264, joining them so that they rotate as a single unit around shaft 266. The knob end 276 of shaft 266 is square in cross-section and fits snugly into a square hole 280 in the center of knob 256. Knob 256 has a flange 280 adjacent to disk 264. Flange 280 is provided with two pegs 282 projecting perpendicularly toward disk 264. When knob 256 is pushed in, pegs 282 slide into peg holes 284 in disk 264. Holes 284 are preferably bored along the perimeter of disk 264 equi-distant from the axis of shaft 266. See FIG. 16.

The square cross-sectional shape of shaft 266 and knob hole 280 prevents knob 256 from rotating relative to shaft 266. Inserting pegs 282 into peg holes 284 of disk 264 thus locks spool 260 against rotation relative to shaft 266. One of two spring-loaded pins 290 and 292 in shaft 266 snap into a recess within knob hole 280. Pins 290 and 292 thereby secure knob 256 in either the pushed in or pulled out position, and keep knob 256 from sliding back and forth on shaft 266 by its own weight. See FIG. 15. Knob 256 is free to slide away from disk 264 so that pulling knob 256 out thus releases the rotational lock. When the locking effect is released, spring 262 rotates spool 260 to draw cord 242 taut.

To pivot sanding end 16, knob 256 is pulled out, unlocking spool 260. Spool 260 rotates to gather or release cord 242, depending on which way tube 160*a* is being pivoted. Helical spring 262 maintains tautness. After pivoting is completed, knob 256 is pushed in and pegs 282 again lock disk 264, and thus spool 260, against rotation. It is the tension in cord 242 which hold end 16 in a pivoted position against the resistance of leaf spring 220 or 222.

Figure 17:
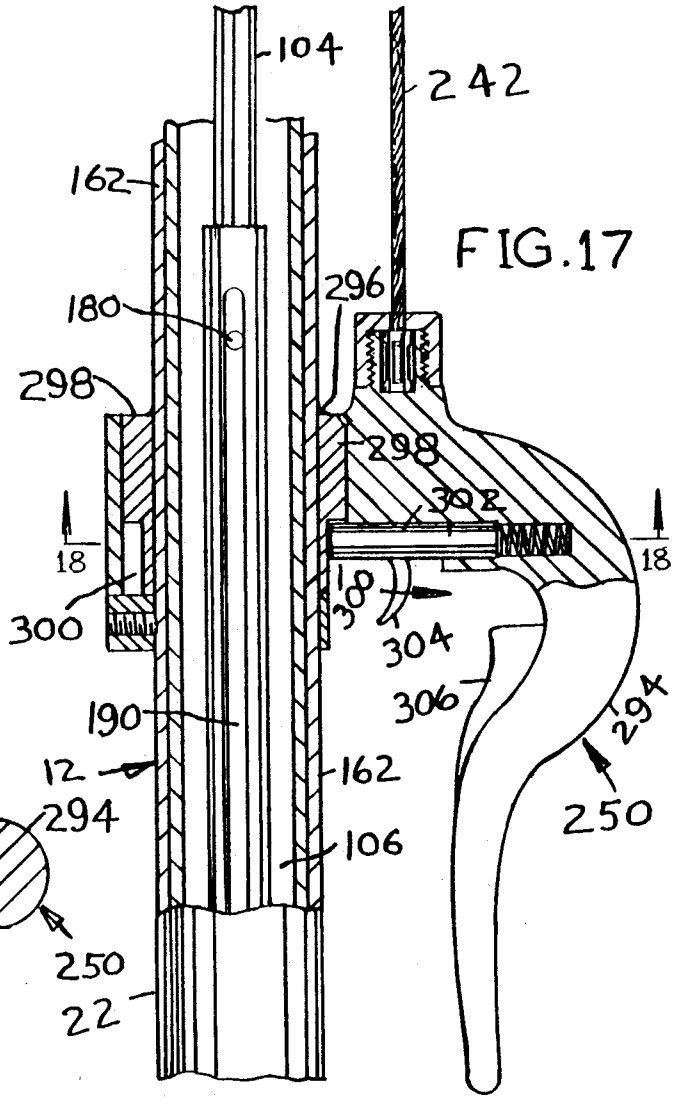
FIG. 17 is a partial sectional view of the tubular body handle, showing the holding cord attachment to the handle and a trigger-operated, spring-loaded bolt for use during rotation of the sanding end, and the telescoping portion of the drive members.

As noted above, cord 242 is secured to handle 250. See FIG. 17. Handle 250 comprises an essentially L-shaped member 294. Member 294 projects out from tube 162, then turns to extend parallel with tube 162 toward motor 20. Cord 242 attaches to member 294. Member 294 is joined to a collar portion 296 which surrounds tube 162. Between collar portion 296 and tube 162 is a ring 298 surrounding and affixed to tube 162 and having a series of holes or notches 300 extending radially into its circumference. See FIG. 18. Member 294 contains a spring-loaded bolt 302 which is radially oriented with respect to ring 298. Bolt 302 slides into whichever one of holes 300 is directly adjacent to it and has a trigger lever 304 affixed perpendicularly to its mid-section. Trigger lever 304 extends out of member 294 parallel to tubular body 12 toward motor 20. When rotation of tube 160 relative to tube 162 is desired, trigger lever 304 is pulled to release bolt 302 from holes 300. Then the user holds onto handle 250 and rotates it around the axis of tubular body 12. This has the effect of rotating sanding assembly 14. Then, when the desired position is reached, trigger 304 is released and bolt 302 slides the hole 300 nearest its new location. This locks tubes 160 and 162 in their new position relative to each other. Contained within member 294 is an electric switch 306 connected to motor 20. Switch 306 gradually increases the speed of motor 20 as it is pressed, rather than being of the on-off variety. Tubular body 12 may be fitted with a carrying strap 308.

Second Preferred Embodiment

FIGS. 19, 20, 21 and 22 illustrate an industrial version 310 of apparatus 10, which is the second preferred embodiment. The industrial version 310 comprises a tubular body 312, handles 314 and 316, and motor switch 320. There also is an electric cable 322 which runs through tubular body 312 to connect the motor switch 320 to the motor 318. Motor 322 is attached to support frame 324 by brackets 326. Support frame 324 is provided with arms 330 having removable arm extensions 332 which are connected to the arms 330 by a releasable connecting means, such as bolts 334. Arm extensions 332 have bearings 336 for axis of rotation axle 340 of sanding assembly 342. A drive belt 344 transmits power from motor drive pulley 338 to cylinder drive pulley 346 fixed to axle 340.

This embodiment comprises another form of sanding assembly 342 which includes the axle 340 and ends 350 and 352. These components are secured together by axle 340. The securing means include a shoulder 354 and a threaded portion 356 in axle 340, together with nut 360; which cooperate with axial openings 362 and 364 in the end portions 350 and 352 and axle shoulder 354.

Strips 370 with abrasive material 372 are mounted to sleeve 374 as described above in connection with sleeve 374. Strips 370 are separately mounted directly to sleeve 374. It is to be noted that in this form the strips 370 are in staggered overlapping rows 380, 382 and 384. It is to be understood that any of the rotary tools of the invention may be supplied with any arrangement of strips described herein.

Cylinder 390 may be removed from support frame 324 by unscrewing bolts 334 and removing at least one arm extension 332. Axle 340 can then be slipped out of the bearings 336 and belt 344 will be loosened. Selected strips 370 can be replaced or the entire array of strips 370 can be replaced by slipping sleeve 374 off for replacement by another. In addition the various components of assembly 342 can be separated for replacement, maintenance or other purpose when it is removed from frame 324, by removing nut 360 and sliding axle 340 out of ends 350 and 352.

Third Preferred Embodiment

Figure 23:
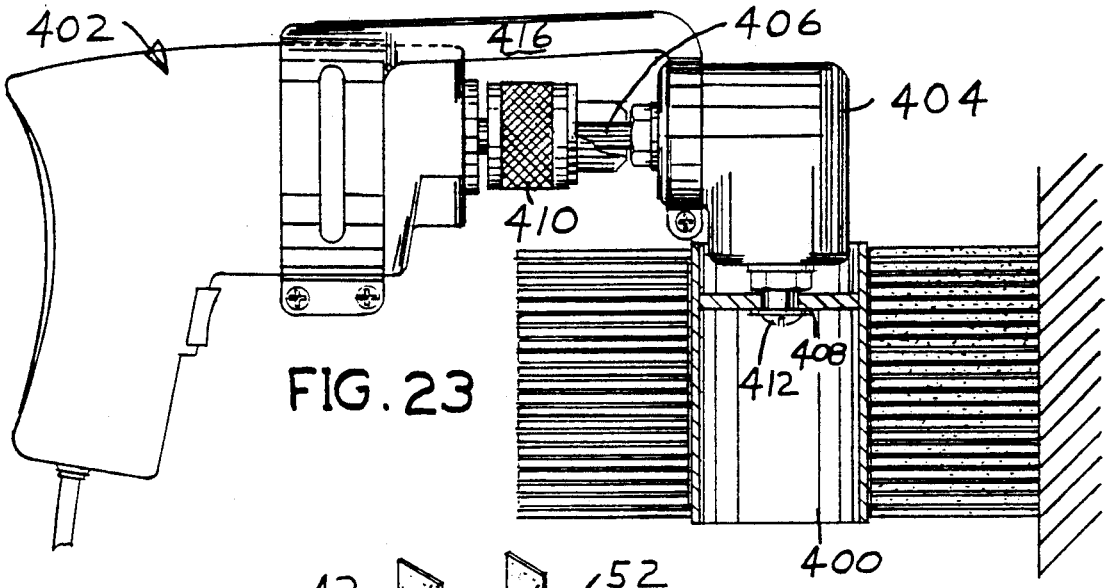
FIG. 23 is a side elevation of the third preferred embodiment of the invention showing a rotary tool and angle drive connected to the chuck of a hand drill with the tool end section engaging a work piece.

The home embodiment of apparatus 10, constituting the third preferred embodiment, is illustrated in FIG. 23. A cylinder 400 is combined with an electric drill 402 (such as the usual ¼ or ⅜ inch types) by means of an angle geared drive 404. The input of drive 404 has a shaft 406 which can be accommodated by chuck 410 of the drill 402. The output of drive 404 has a shaft 408 which receives a removable fastener 412 to fix it to cylinder 400. Gear drive 404 can be eliminated from the home embodiment in which case cylinder 400 may be provided with an axial shaft to fit the drill chuck 410 directly in axis of rotation alignment. A brace 416 connects angled gear drive 404 to drill 402.

Figure 18:
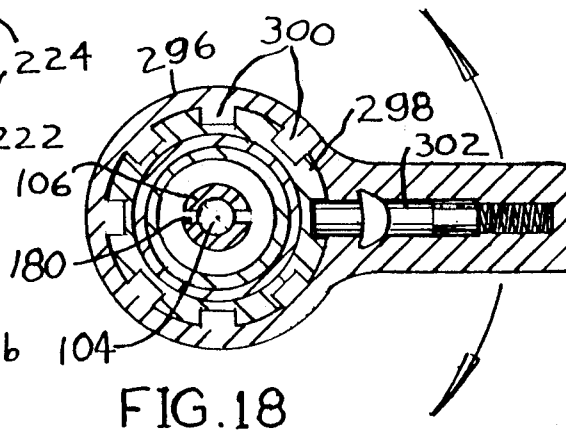
FIG. 18 is a sectional view along line 18—18 of FIG. 17 illustrating a notched collar which the spring-loaded bolt of FIG. 17 engages, and also illustrating with arrows the two directions of rotation which the tubular body can take.

Sleeve 44, see FIG. 2, and sleeve 374 see FIG. 18 may be of elastic material having the ability to stretch and slide either over cylinder 70 of assembly 14 or of cardboard, metal or plastic. For example FIG. 9, together with FIG. 8 from which it was taken, shows sleeves 374 made of a plastic material with flexing properties. Each sleeve 374 has a pair of spacings 412 to permit end section 414 between them to flex away from outer surface 416 of cylinder 70 so that indent button 420 can snap into opening 422 to secure the sleeve 374. In this version of the assembly 14, cylinder 70 also has shoulder portions 430 and 432 to position sleeve 374. See FIG. 8.

Fourth Preferred Embodiment

Figure 24:
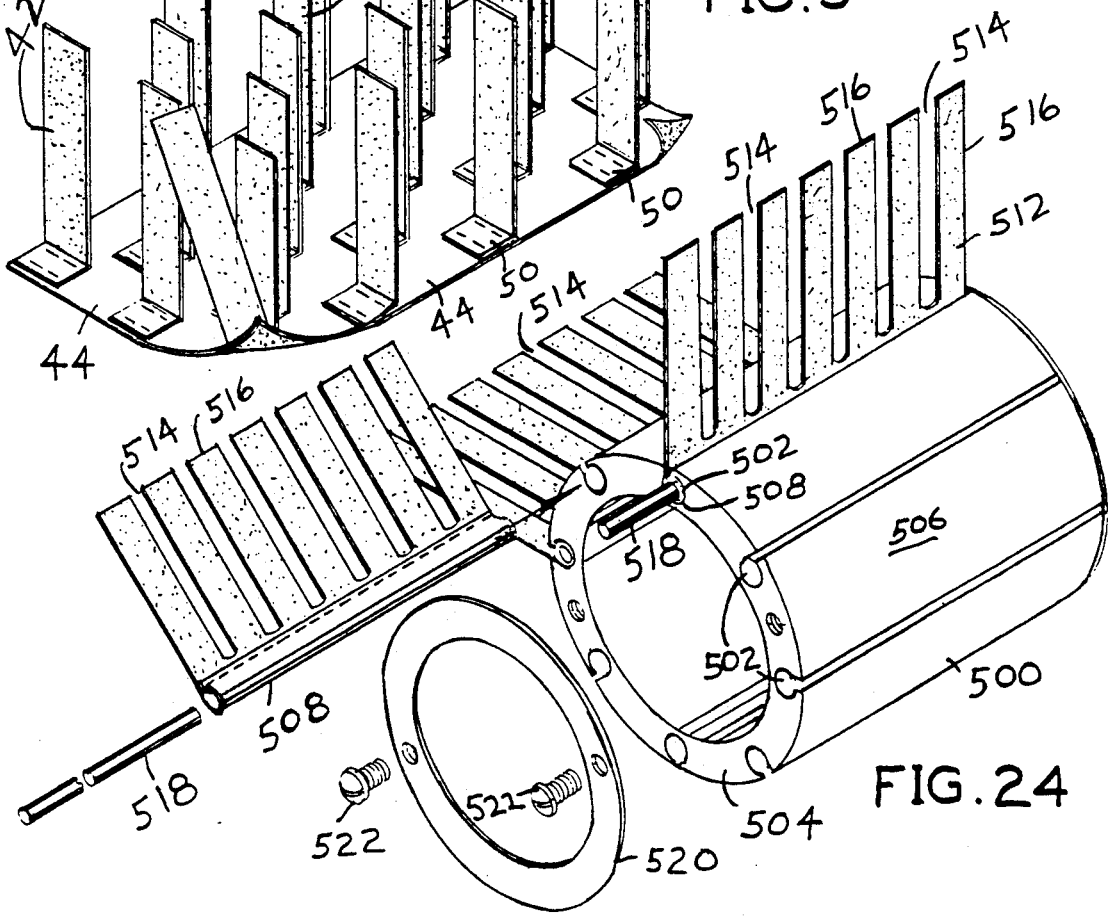
FIG. 24 is a perspective of the fourth preferred embodiment having a cylinder for holding working strips with part of the view exploded to show the replacement feature for groups of assembled strips as indicated by the arrow.

Referring now to FIG. 24, another cylinder 500 has a series of mounting stations 502 in the thickness 504 of wall 506 of sleeve 500. The mounting stations 502 have slots 510 offset from their centers. Sheets of sandpaper 512 are provided with spaces 514 to form strips 516 at one end. The other end forms a cylindrical loop 508 which wraps around a mounting rod 518 and then loop 508 and rod 518 are inserted into mounting station 502, as shown by the arrow in FIG. 24. A retaining plate 520 is then secured over the ends of stations 502 with bolts 522.

Fifth Preferred Embodiment

Figure 25:
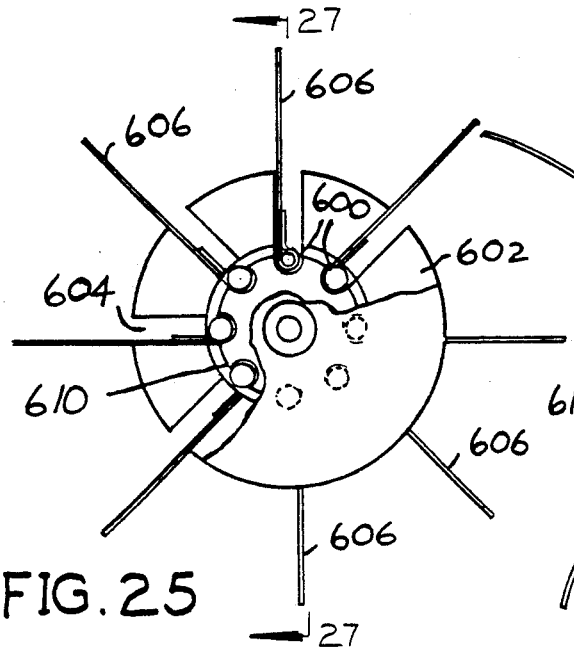
FIG. 25 shows the fifth preferred embodiment in a partial sectional side view, wherein sanding element mounting rods slide along radial slots, when the element is rotated.
Figure 26:
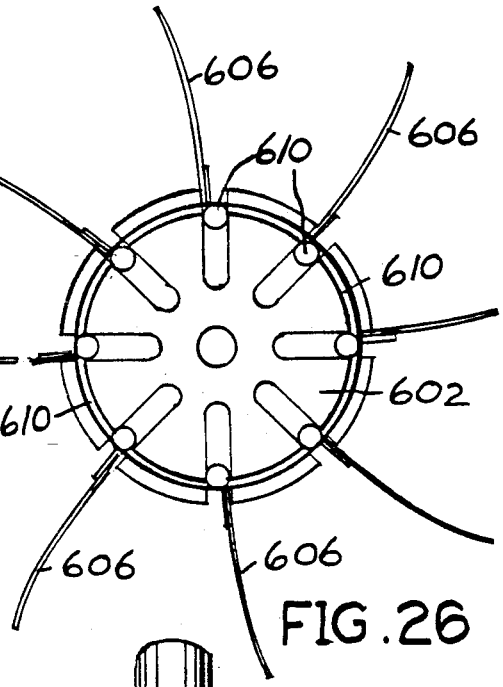
FIG. 26 shows the fifth preferred embodiment with the sanding elements at full extension.
Figure 27:
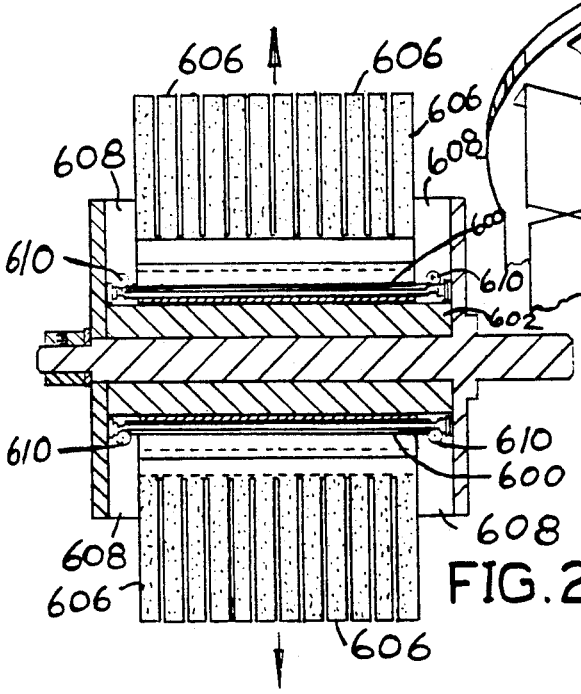
FIG. 27 is a sectional front view of the fifth preferred embodiment, taken along line 27—27 of FIG. 25.
Figure 28:
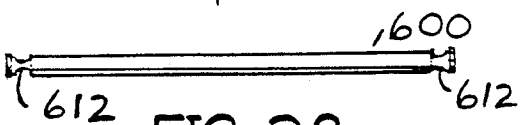
FIG. 28 is a separate view of one of the sliding rods of the fifth preferred embodiment.

Another embodiment has strip mounting rods 600 slidingly mounted within specially designed cylinders 602, parallel with the axis of cylinder 602. See FIG. 25. Rods 600 slide radially outward from the cylinder axis along radial slots 604 when cylinder 602 is rotated. See FIG. 26. When not rotated, rods 600 slide back into cylinder 602, conserving space and protecting strips 606. FIG. 27 is a sectional front view of this variation. FIG. 28 is a separate view of one of the sliding rods 600. A slot 608 is formed around the circumference of cylinder 602. An elastic retaining band 610 is fit into each slot to retain rods 600. Notches 612 are provided in the ends of rods 600 to receive bands 608.

Sixth Preferred Embodiment

Figure 29:
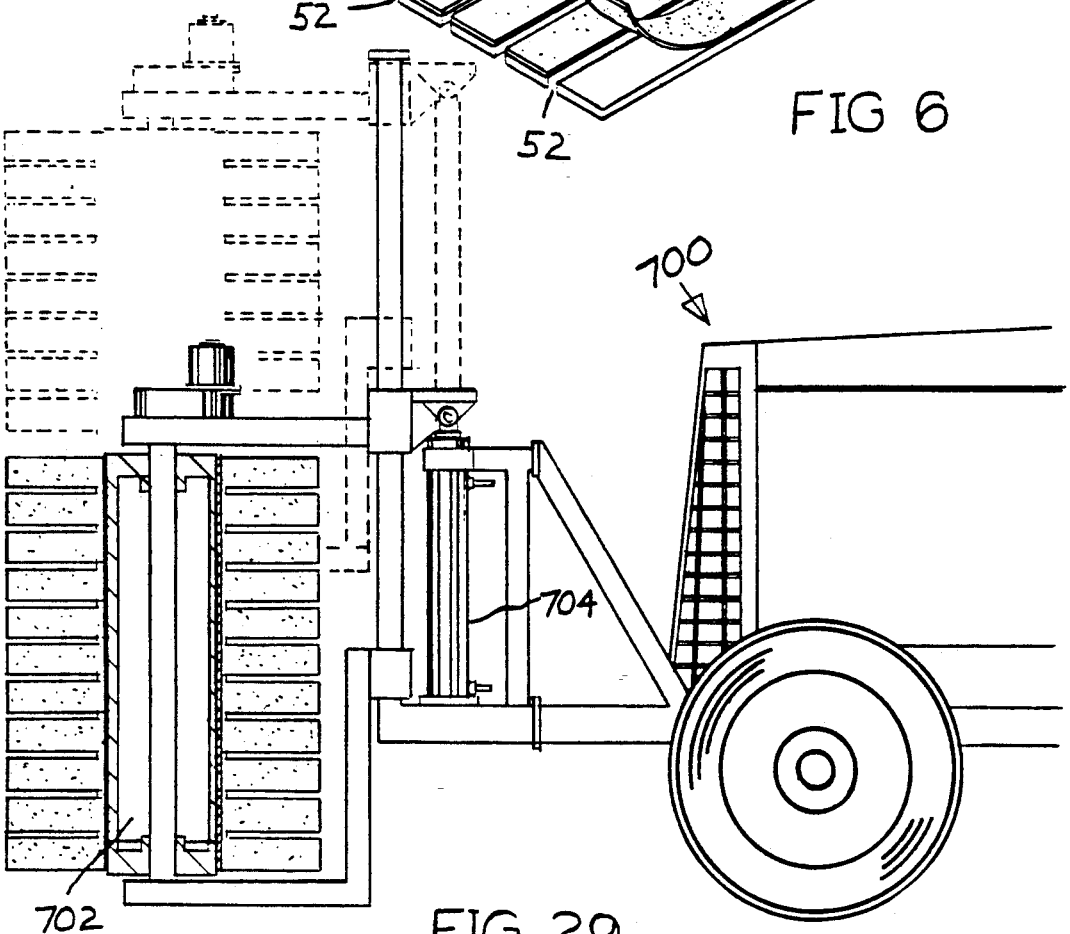
FIG. 29 illustrates the sixth preferred embodiment which is a large industrial version of the invention, mounted on the back of a truck, wherein the axis of the rotating cylinder is vertical and the cylinder is raised and lowered by means of a hydraulic cylinder on the back of the truck. This embodiment is intended for polishing the inner surfaces of large storage drums and pipes.
Figure 6A:
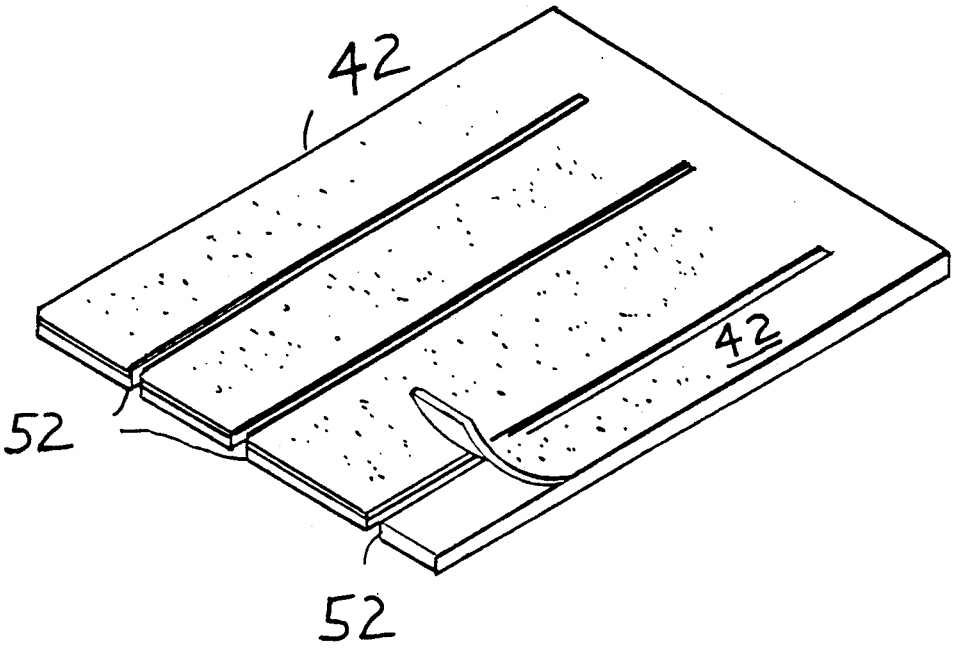
FIG. 6a shows alternative strips cut to varying widths.

FIG. 29 is a large industrial version of the invention mounted on the back of a truck 700 or other vehicle. The axis of the rotating cylinder 702 is vertical and cylinder 702 is raised and lowered with a hydraulic cylinder 704 on the back of truck 700. This embodiment is intended for polishing the inner surfaces of large storage drums and pipes.

Seventh Preferred Embodiment

Figure 30:
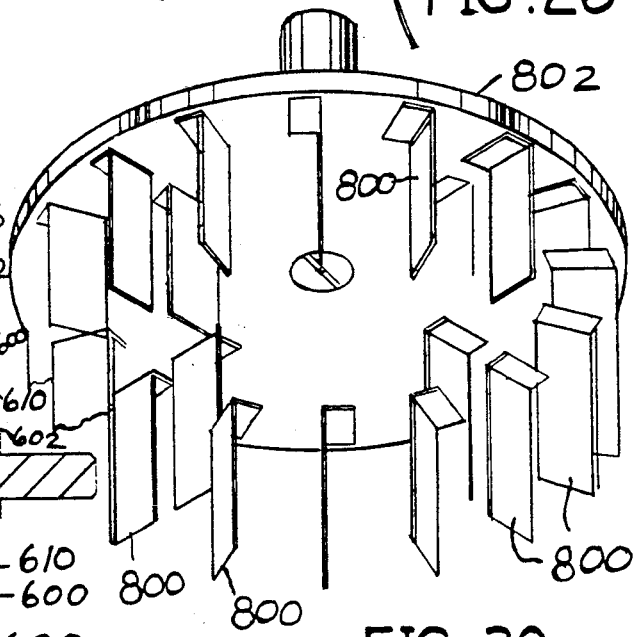
FIG. 30 illustrates the seventh preferred embodiment of the invention wherein the flaps are mounted on a rotating disk rather than on a cylinder.

Another embodiment of the invention features strips 800 mounted on a rotating disk 802 rather than on a cylinder. See FIG. 30.

Eighth Preferred Embodiment

Figure 31:
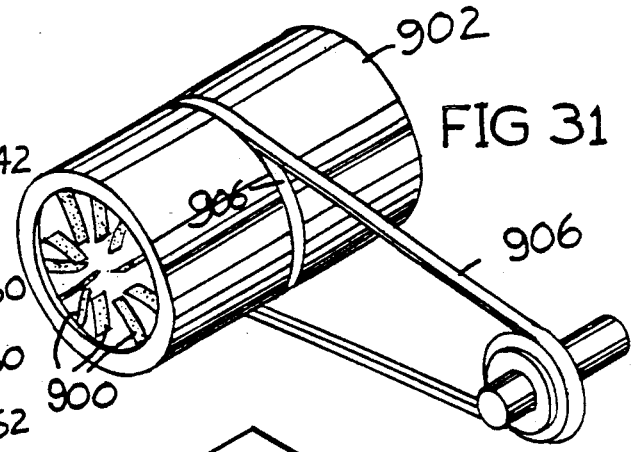
FIG. 31 illustrates the eighth preferred embodiment of the invention, which is intended for polishing outer surfaces of generally cylindrical objects. The strips of this embodiment are mounted on the inside rather than on the outside of a tubular rotating cylinder. The object to be polished is inserted into the cylinder. The cylinder is rotated by a belt drive, as shown.

Still another embodiment of the invention is designed for polishing outer cylindrical surfaces. See FIG. 31. Strips 900 are mounted on the inside rather than on the outside of the rotating cylinder 902 and the object to be polished is inserted inside cylinder 902. Cylinder 902 is operated by a drive belt 904 as shown, and drive belt 904 fits into guide groove 906 in cylinder 902.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An apparatus for sanding a work piece comprising:

a cylindrical mounting surface having an axis of rotation and a plurality of strips disposed radially with relation to said axis and laterally to themselves, at least one of said strips having a front face comprising abrasive grit material such that sliding said front face over said work piece sands said work piece, and said strips being laterally and circumferentially spaced apart from each other, an annular cylinder assembly, to which said strips are attached, adapted to removably slide fit over said mounting surface.

2. An apparatus according to claim 1 wherein said strips are of uniform width.

3. An apparatus according to claim 1 wherein said strips are of varying width.

4. An apparatus according to claim 1 wherein said strips are mounted adjacent to each other in a plurality of rows.

5. An apparatus according to claim 1 wherein the strips are in rows with strips in staggered row to row relationship.

6. An apparatus according to claim 1 wherein the strips are cut at their ends to form a plurality of narrower strips.

7. An apparatus according to claim 1 wherein said strips are reinforced with a flexible material for added strength and resiliency.

8. An apparatus according to claim 1 wherein at least one row of strips is mounted parallel to the axis.

9. An apparatus according to claim 1 wherein the strips are in string form comprising abrasive material.

10. An apparatus according to claim 9 wherein the strings are plastic coated with an adhesive material.

11. An apparatus according to claim 1 in which the strips are elastic.

12. An apparatus according to claim 9 which the strips are elastic.

13. An apparatus according to claim 1, wherein said annular cylinder assembly comprises an annular cylinder outer surface and comprises a first elastic sleeve which slidingly fits over said annular cylinder outer surface, to which said strips are attached.

14. An apparatus according to claim 13 in which the sleeves are cylindrical.

15. An apparatus according to claim 1 and further comprising:

at least one securing means for the sleeve and the mounting surface.

16. An apparatus according to claim 15 wherein the securing means comprises at least one indent button.

17. An apparatus according to claim 1 and further comprising in combination:

a motor drive system.

18. The combination according to claim 17 wherein the motor drive system is a hand held electric drill.

19. The combination according to claim 18 wherein the mounting surface is connected to the drill by means of an angle drive.

20. The combination according to claim 17 further comprising:

at least one telescopic housing.

21. The combination according to claim 20 further comprising:

a drive shaft including a first flexible drive shaft portion and a second drive shaft portion.

22. The combination according to claim 21 further comprising:

a first telescopic housing and a second telescopic housing.

23. The combination according to claim 22 further comprising:

at least one bearing between at least one of the housings and at least one of the drive shaft portions.

24. The combination according to claim 23 further comprising:

a lock for the telescopic housings.

25. The combination according to claim 24 further comprising:

a third drive shaft portion and keying means associated with the second and third drive shaft portions.

26. The combination according to claim 25 further comprising:

pivot means associated with the drive shaft and the axis of rotation of the apparatus.

27. The combination according to claim 26 wherein the pivot means comprises a flexible portion of the drive shaft.

28. The combination according to claim 25 further comprising:

a flexible portion of the drive shaft and at least one coupling having ball and socket means.

29. The combination according to claim 26, wherein the pivot means comprises spring means which resist pivoting.

30. The combination according to claim 29 wherein holding cord means maintain a pivot position against resistance of said springs.

31. The combination according to claim 30 comprising cord gathering means to keep the cord taut during pivoting.

32. The combination according to claim 31 wherein said cord gathering means comprises a spool for said cord and a helical spring for rotating said spool.

33. The combination according to claim 32 additionally comprising a rotational lock for said spool.

34. The combination according to claim 17 comprising a handle containing an electric switch for operating said motor drive system.

35. The combination according to claim 22 additionally comprising a rotational lock which can be disengaged to permit the first telescopic housing to rotate relative to the second telescopic housing.

36. An apparatus for sanding a work piece comprising:

a mounting surface having an axis of rotation and a plurality of strips disposed radially with relation to the axis and laterally to themselves with at least a portion of said strips comprising abrasive material, a motor drive system, a drive shaft including a first flexible drive shaft portion and a second drive shaft portion, a third drive shaft portion and keying means associated with the second and third drive shaft portions, a first telescopic housing, a second telescopic housing, at least one bearing between at least one of the housings and at least one of the drive shaft portions, a lock for the telescopic housings.

37. The combination according to claim 36 further comprising:

pivot means associated with the drive shaft and the axis of rotation of the apparatus.

38. The combination according to claim 37 wherein the pivot means comprises a flexible portion of the drive shaft.

39. The combination according to claim 36 further comprising:

a flexible portion of the drive shaft and at least one coupling having ball and socket means.

40. The combination according to claim 39 wherein holding cord means maintain a pivot position against the resistance of said springs.

41. The combination according to claim 40 comprising cord gathering means to keep the cord taut during pivoting.

42. The combination according to claim 41 wherein said cord gathering means comprises a spool for said cord and a helical spring for rotating said spool.

43. The combination according to claim 42 additionally comprising a rotational lock for said spool.

44. An apparatus for sanding a work piece comprising:

a mounting surface having an axis of rotation and a plurality of strips disposed radially with relation to the axis and laterally to themselves with at least a portion of said strips comprising abrasive material, a motor drive system, a handle containing an electric switch for operating said motor drive system.

45. An apparatus for sanding a work piece comprising:

a mounting surface having an axis of rotation and a plurality of strips disposed radially with relation to the axis and laterally to themselves with at least a portion of said strips comprising abrasive material, a motor drive system, a drive shaft including a first flexible drive shaft portion and a second drive shaft portion, a first telescopic housing and a second telescopic housing, a rotational lock which can be disengaged to permit the first telescopic housing to rotate relative to the second telescopic housing.

46. An apparatus for sanding a work piece comprising:

a mounting surface having an axis of rotation and a plurality of strips disposed radially with relation to said axis and laterally to themselves, with at least a portion of said strips comprising abrasive material, a motor drive system, a drive shaft including a first flexible drive shaft portion and a second drive shaft portion, a first telescopic housing and a second telescopic housing, at least one bearing between at least one of said housings and at least one of said drive shaft portions, a lock for said telescopic housings, and a third drive shaft portion and keying means associated with said second and third drive shaft portions.

47. The combination according to claim 46, further comprising pivot means associated with said drive shaft and the axis of rotation of the apparatus.

48. The combination according to claim 47, wherein said pivot means comprises a flexible portion of said drive shaft.

49. The combination according to claim 46, further comprising:

a flexible portion of said drive shaft and at least one coupling having ball and socket means.

50. The combination according to claim 47, wherein said pivot means comprises spring means which resist pivoting.

51. The combination according to claim 50, wherein holding cord means maintain a pivot position against resistance of said springs.

52. The combination according to claim 51, further comprising cord gathering means to keep said cord taut during pivoting.

53. The combination according to claim 52, wherein said cord gathering means comprises a spool for said cord and a helical spring for rotating said spool.

54. The combination according to claim 53, further comprising a rotational lock for said spool.

55. The combination according to claim 46, further comprising a rotational lock which can be disengaged to permit said first telescopic housing to rotate relative to said second telescopic housing.

* * * * *